US008567491B2

(12) United States Patent
Lurie

(10) Patent No.: US 8,567,491 B2
(45) Date of Patent: Oct. 29, 2013

(54) DEVICE AND METHOD OF LINING A WELLBORE

(75) Inventor: Paul George Lurie, Dorset (GB)

(73) Assignee: BP Exploration Operating Company Limited, Middlesex (GB)

( * ) Notice: Subject to any disclaimer, the term of this patent is extended or adjusted under 35 U.S.C. 154(b) by 0 days.

(21) Appl. No.: 12/736,208

(22) PCT Filed: Mar. 18, 2009

(86) PCT No.: PCT/GB2009/000731
§ 371 (c)(1),
(2), (4) Date: Feb. 8, 2011

(87) PCT Pub. No.: WO2009/115803
PCT Pub. Date: Sep. 24, 2009

(65) Prior Publication Data

US 2011/0120732 A1 May 26, 2011

(30) Foreign Application Priority Data

Mar. 20, 2008 (EP) ..... 08251019

(51) Int. Cl.
*E21B 27/00* (2006.01)

(52) U.S. Cl.
USPC ..... 166/107; 166/380; 175/107; 175/57; 175/371; 405/146

(58) Field of Classification Search
USPC ..... 175/230, 57, 408, 393, 371, 340, 171, 175/52, 78; 166/380, 207, 242.2, 177.4, 166/107; 405/146
See application file for complete search history.

(56) References Cited

U.S. PATENT DOCUMENTS

| | | | | |
|---|---|---|---|---|
| 4,431,069 | A | 2/1984 | Dickinson et al. | |
| 4,813,495 | A * | 3/1989 | Leach | 175/6 |
| 6,138,777 | A * | 10/2000 | Fraim et al. | 175/92 |
| 2007/0068705 | A1 * | 3/2007 | Hosie et al. | 175/57 |
| 2007/0215343 | A1 * | 9/2007 | McDonald et al. | 166/105 |

FOREIGN PATENT DOCUMENTS

WO WO 2005/024178 3/2005

OTHER PUBLICATIONS

International Search Report for PCT/GB2009/000732, mailed May 8, 2009.
Written Opinion of the International Searching Authority for PCT/GB2009/000732, mailed May 8, 2009.

* cited by examiner

*Primary Examiner* — Yong-Suk (Philip) Ro
(74) *Attorney, Agent, or Firm* — Nixon & Vanderhye

(57) ABSTRACT

Device for lining the wall of a wellbore as it is being drilled using a drill string having a drill bit on the lower end thereof. The device has a receptacle for a cylindrically gathered pack of flexible tubing capable of being supported around the outside of the drill string near the lower end thereof on a plurality of bearings, a radially expandable locking device attachable to one end of the flexible tubing and being capable of being expanded against the wellbore wall to lock the end of the flexible tubing in place in the wellbore, and a conduit having an inlet upstream of the receptacle and an outlet downstream of the receptacle. A pump is located in the conduit or abutting the inlet or outlet thereof, and pumps the drilling fluid so that a fluid pressure inside the liner is greater than a fluid pressure at the drill bit.

14 Claims, 1 Drawing Sheet

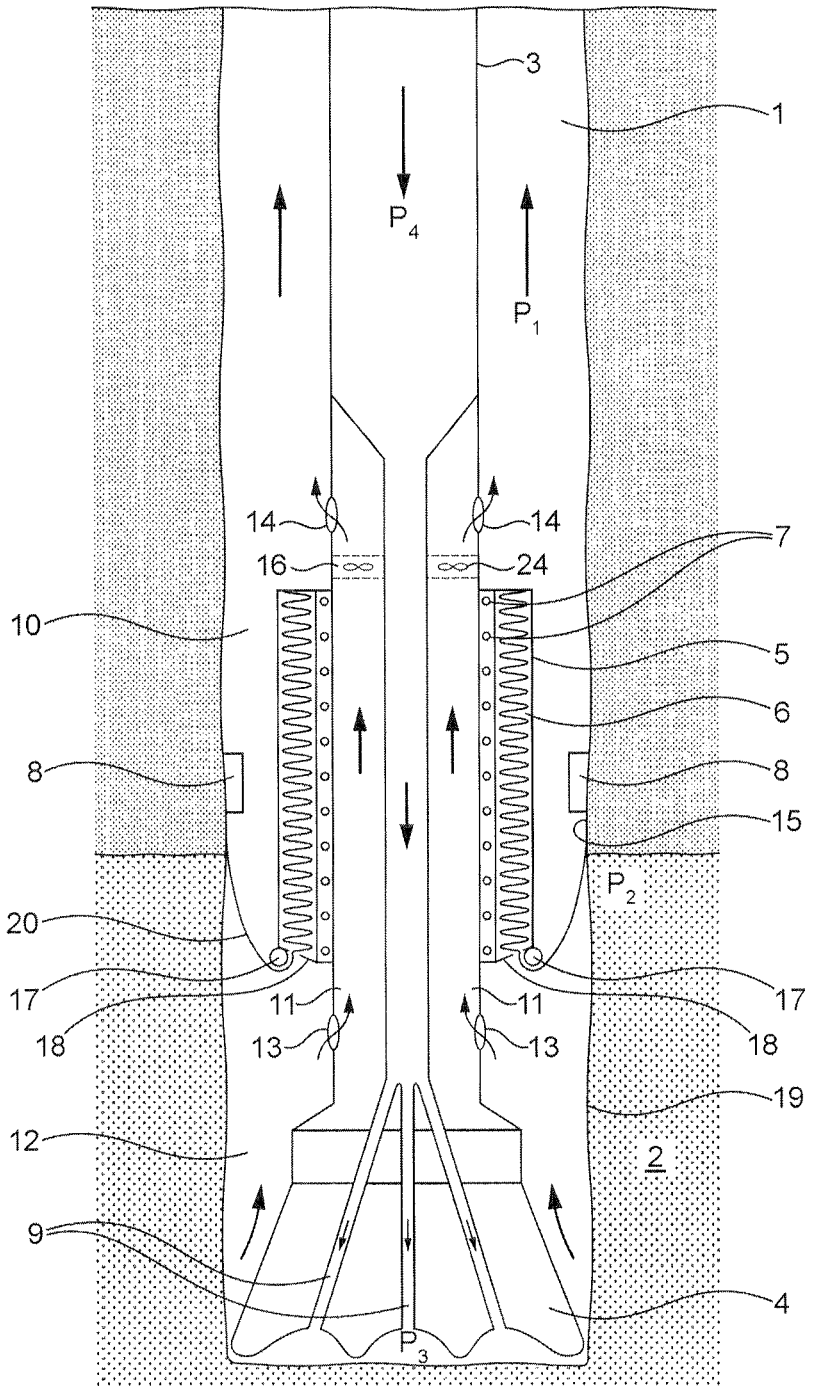
3
1
P4
P1
14
14
16
24
7
10
5
6
8
8
15
P2
20
17
17
11
11
18
13
13
18
19
12
2
9
4
P3

DEVICE AND METHOD OF LINING A WELLBORE

This application is the U.S. national phase of International Application No. PCT/GB2009/000731 filed 18 Mar. 2009, which designated the U.S. and claims priority to EP Application No, 08251019.9 filed 20 Mar. 2008, the entire contents of each of which are hereby incorporated by reference.

This invention relates to drilling of wells through a hydrocarbon bearing subterranean formation, and more particularly to a method of lining a wellbore wall as it is being drilled and to a device suitable for use in the method.

BACKGROUND OF THE INVENTION

In the drilling of a wellbore through a subterranean formation by rotary drilling techniques, conventionally a drilling fluid is circulated from a well head, which may be at the surface of the earth, down a drill string having a drill bit on the lower end thereof and through ports provided in the drill bit to the well bottom and thence back to the well head e.g. the surface through the annulus formed about the drill string. Commonly, drilling fluids are employed that are either oil or water based. These fluids are treated to provide desired rheological properties which make the fluids particularly useful in the drilling of wellbores.

A problem often encountered in the drilling of a well bore is the loss of unacceptably large amounts of drilling fluid into the subterranean formation penetrated by the wellbore. This problem is often referred to generally as "lost circulation", and the formation zones into which the drilling fluid is lost are often referred to as "lost circulation zones" or "thief zones". Various causes may be responsible for the lost circulation encountered in the drilling of a wellbore. For example, a formation penetrated by the wellbore may exhibit unusually high permeability or may contain fractures or crevices therein. In addition, a formation may simply not be sufficiently competent to support the hydrostatic pressure applied by the drilling fluid and may break down under this hydrostatic pressure and allow the drilling fluid to flow thereinto.

In an attempt to overcome these problems and prevent loss of drilling fluid from the wellbore, a device was proposed in WO2005/024178, the disclosure of which is herein incorporated by reference. The proposed device was for lining the wall of a wellbore as it is being drilled through a subterranean formation using a drill string having a drill bit on the lower end thereof, the device comprising:

(a) a receptacle for a cylindrically gathered pack of flexible tubing and (b) a radially expandable locking means having means for directly or indirectly attaching a first end of the tubing of the gathered pack wherein (ii) the receptacle for the gathered pack of flexible tubing is capable of being supported around the outside of the drill string at or near the lower end thereof on a plurality of bearings thereby allowing the receptacle to remain stationary while the drill string is rotated; and (iii) the radially expandable locking means is capable of being expanded against the wellbore wall thereby locking the first end of the flexible tubing in place in the wellbore such that in use movement of the drill string through the wellbore as it is being drilled causes the flexible tubing to be withdrawn from the cylindrically gathered pack and to be turned inside out thereby providing a liner for the wellbore wall with the outer surface of the tubing of the cylindrically gathered pack forming the inner surface of the liner.

WO 2005/024178 also describes that device with the gathered pack of flexible tubing as well, and a method of sealing the wall of a well bore using the device. In a conventional drilling operation the drill fluid containing the drill cuttings in the entrained cuttings stream returns from the drill bit to the well head up the annulus between drill string and well bore or casing. But according to WO2005/024178 the entrained cuttings stream is prevented in this case from passing directly back to the well head over the outside of the drill string owing to the fluid barrier imposed by the withdrawn flexible tubing. Accordingly, a fluid by-pass is provided for the entrained cuttings stream. For example, the interior of the drill string may be provided with at least one conduit having an inlet below the cylindrical receptacle for the gathered pack of tubing and an outlet above the cylindrical receptacle such that the entrained cuttings stream passing through the conduit bypasses the cylindrical receptacle. Alternatively, the cylindrical receptacle may itself be provided with a fluid by-pass. The entrained cuttings stream then flows to the surface through the annulus formed about the drill string in the standard manner.

However the fluid barrier provided by the withdrawn flexible tubing still creates a problem, namely that the tubing, as the sheath, can peel off the well bore wall back to an expanded locking means.

SUMMARY OF THE INVENTION

This problem is overcome according to the present invention by providing a pump to pump fluid downstream of the fluid barrier.

The present invention provides a device for lining the wall of a wellbore as it is being drilled through a subterranean formation using a drill string having a drill bit on the lower end thereof, the device comprising:

(a) a receptacle for a cylindrically gathered pack of flexible tubing capable of being supported around the outside of the drill string at or near the lower end thereof on a plurality of bearings thereby allowing the receptacle to remain stationary while the drill string is rotated; and (b) a radially expandable locking means having means for directly or indirectly attaching a first end of the tubing of the gathered pack;

said radially expandable locking means being capable of being expanded against the wellbore wall so as to lock the first end of the flexible tubing in place in the wellbore such that in use movement of the drill string through the wellbore as it is being drilled is capable of causing the flexible tubing to be withdrawn from the cylindrically gathered pack and to be turned inside out thereby providing a liner for the wellbore wall with the outer surface of the tubing of the cylindrically gathered pack forming the inner surface of the liner; and (c) at least one conduit having an inlet upstream of the receptacle and an outlet downstream of the receptacle;

characterised in that the device further includes at least one pump located at least partly in the conduit or abutting the inlet or outlet thereof for pumping fluid from an upstream side of the receptacle to a downstream side of the receptacle. By upstream and downstream, it is meant the general direction in which fluid flows from the drill bit and up the wellbore to the surface.

A cylindrically gathered pack of flexible tubing can be housed in the receptacle.

The conduit may extend through the receptacle or a housing associated therewith. Alternatively, the device may further include a drill string section through which at least part of the conduit extends. In this case, the receptacle can be supported on the drill string section.

There is also provided a drilling system for drilling a wellbore through a subterranean formation comprising a drill string having a drill bit on the lower end thereof, and a device comprising a receptacle, a radially expandable locking means, and flexible tubing, said flexible tubing extending from a first portion thereof in a gathered pack in said receptacle to a second portion thereof held in use against said well bore by said locking means, via a third portion of said tubing extending between the gathered pack and said locking means, which third portion is capable during drilling of blocking passage of drilling fluid between said receptacle and said well bore, the system further including at least one conduit within the drill string, each conduit having below the receptacle at least one inlet from outside the drill pipe and having above the receptacle at least one outlet to outside the drill pipe, characterized in that at least one pump is located at least partly in the conduit or abutting an outlet or inlet thereof.

The present invention also provides a method of sealing the wall of a well bore as it is being drilled through a subterranean formation using a drill string having a drill bit on the lower end thereof, which method comprises fitting the device of the invention to the lower end of a drill string and drilling a first section of wellbore using a drilling fluid, expanding the locking means against the wellbore wall such that the first end of the tubing that is withdrawn from the gathered pack is locked in place in the wellbore, drilling a second section of wellbore with the movement of the drill string through the wellbore capable of causing the tubing to be withdrawn from the gathered pack and to be turned inside out thereby forming a liner for the second section of wellbore, the drilling fluid being moved through said conduit at least partly by the pump.

Also provided by the present invention is a method of drilling a wellbore through a subterranean formation using a drill string having a drill bit on the lower end thereof, and a device comprising said receptacle, said radially expandable locking means, and flexible tubing, which extends from a first portion thereof in a gathered pack in said receptacle to a second portion thereof held in use against said well bore by said locking means, via a third portion of said tubing extending between the gathered pack and said locking means, which third portion is capable during drilling of blocking passage of drilling fluid between said receptacle and said well bore, at least one conduit within the drill string, each conduit having below the receptacle at least one inlet from outside the drill pipe and having above the receptacle at least one outlet to outside the drill pipe, which comprises passing drilling fluid down said drill string over said drill bit to produce an entrained drill cuttings stream, passing said stream up the lower annulus between said drill string and said well bore below the receptacle until passage is blocked by said third portion of tubing, and passing said stream through at least one of said inlets of said conduit and out thereof through at least one of said outlets into an upper annulus between said drill string and said well bore above the receptacle characterized in that said drilling fluid is partly moved through said conduit by a pump located at least partly in the conduit or abutting an outlet or inlet thereof.

When drilling through a lost circulation zone, the radially expandable means is radially expanded against the wellbore above the lost circulation zone such that, as the drill string moves down through the lost circulation zone, the wellbore is lined. The pump increases the pressure in the region above the receptacle above what it otherwise would be, so as to reduce the likelihood of the tubing peeling away from the well bore wall.

For avoidance of doubt, the device of the present invention may be used to drill a sidetrack or lateral well in addition to drilling a substantially vertical wellbore. Although the present invention is particularly suitable for lining lost circulation zones, it will be apparent that it may be used in other sections of the well bore Suitably, the flexible tubing is withdrawn from the bottom of the cylindrically gathered pack as the wellbore is being drilled and is subsequently turned inside out to form a sleeve or liner for the wellbore. Thus, the outer surface of the flexible tubing in the gathered pack becomes the cylindrical inner surface of the liner. Suitably, the receptacle is arranged around the outside of the drill string immediately above the drill bit. Preferably, the receptacle for the gathered pack comprises an inner tube and an outer tube with the gathered pack of flexible tubing stored in the annular space formed between the inner and outer tubes and the drill string passing through the interior of the inner tube. Suitably, the inner tube of the receptacle is provided with a plurality of bearings, for example, roller bearings thereby allowing the drill string to rotate whilst the receptacle remains stationary relative to the drill string. Suitably, the roller bearings are distributed along the length of the inner tube of the receptacle. As the drill bit drills the borehole through the lost circulation zone, the first end of the tubing (also described herein as the second portion of the flexible tubing) that is being withdrawn from the gathered pack remains locked in place in the wellbore above the lost circulation zone through expansion of the locking means against the wellbore wall whilst the drill string and the receptacle that is supported at or near the lower end thereof moves through the wellbore as it is being drilled. Thus, movement of the drill string through the wellbore causes the flexible tubing to be withdrawn from the gathered pack and to be turned inside out thereby forming the liner for the wellbore.

Suitably, the cylindrically gathered pack of tubing is formed from a flexible, non-resilient material, for example, a plastic material. The material forming the tubing is resistant to the well environment, i.e. temperature, pressure, well fluids, and the like. The material is also impermeable to wellbore liquids such as crude oil, water and gas field condensate. However, the material may be partially or fully permeable to natural gas. Examples of suitable plastic materials include polyvinylchloride (PVC), polyamides (for example, polyamide 11) and high-density polyethylene (HDPE).

Preferably, the tubing of the gathered pack has a wall thickness of 0.1 to 2 mm.

The liner is held against the wellbore wall to seal the wellbore wall owing to a pressure differential that exists across the liner. Accordingly, the diameter of the flexible tubing should correspond to the inner diameter of the wellbore that is being drilled. The outer diameter of the tubing of the gathered pack may be in the range 4 to 12 inches (10 to 30 cm), preferably 6 to 10 inches (15 to 25 cm), more preferably 8 to 9 inches (20 to 23 cm), for example, 8.5 inches (21.6 cm), depending on the inner diameter of the wellbore that is being drilled.

The length of the flexible tubing in the gathered pack should be at least as long as the section of wellbore that is to be drilled through the lost circulation zone. Suitably, the length of the flexible tubing of the gathered pack is in the range 30 to 5000 feet (9 to 1524 m) depending on the length of the lost circulation zone.

Where the gathered pack of flexible tubing is stored in the annular space formed between the inner and outer tubes of the receptacle, the top of the receptacle may be closed. Suitably, the bottom of the receptacle may comprise a ring base that supports the gathered pack of tubing and has sufficient clearance to enable the tubing be withdrawn from the gathered pack. Suitably, the clearance is provided at or near the outer wall of the tubular container. Preferably, the ring base is angled downwardly thereby acting as a guide means for the flexible tubing. For example the ring may be flared outwardly from at or near the inner wall of the tubular container. It is also envisaged that the upper end of the gathered pack may be locked or fixed in place in the upper end of the receptacle in which case the ring base may be omitted. Preferably, the outer tube is provided with a guide means to assist in turning the flexible tubing inside out as it emerges from the base of the receptacle such that the outer surface of the flexible tubing in the pack forms the inner surface of the liner that seals the wellbore.

Suitably, the liner is held against the wellbore wall owing to a pressure differential that exists across the liner. Thus, the pressure in the annulus that is formed between the liner and the drill string, $P_1$, is greater than the pressure in the formation, $P_2$. Suitably the pressure differential, $\Delta P$, across the liner, (where $\Delta P=P_1-P_2$) is at least 100 psi (0.7 MPa), preferably in the range 100 to 3000 psi (0.7 to 21 MPa) such as 100-500 psi (0.7-3.5 MPa) or more preferably 100-300 psi (0.7-2.1 MPa).

The first end of the tubing that is withdrawn from the gathered pack is connected either directly or indirectly to the radially expandable locking means such that expansion of the locking means against the wellbore wall locks the end of the tubing in place in the wellbore. An annulus is provided between the expanded locking means and the drill string thereby allowing the drill string to move through the interior of the expanded locking means. Suitably, the annulus has a radial width of at least 0.5 inch (1.3 cm), preferably at least 1 inch (2.5 cm) such that there is sufficient clearance for the drill string to move downwardly through the expanded locking means. Suitably, the radially expandable locking means and hence the end of the tubing that is withdrawn from the gathered pack is locked in place in the wellbore immediately above a loss circulation zone of the formation or a region of possible pressure variation in the formation, as described further below. The radially expandable locking means may be expanded using any suitable means known to the person skilled in the art. Typically, the radially expandable locking means is hydraulically expanded using the fluid that is pumped through the interior of the drill string. For example, the radially expandable locking means may be expanded by diverting the fluid to the radially expandable locking means such that the locking means is hydraulically expanded against the wellbore wall. Suitably, a ball may be dropped down the drill string to sit on a ring seal provided in the interior of the drill string thereby activating a one-way valve that is in fluid communication with the radially expandable locking means. As the fluid is pumped down the drill string at a predetermined first pressure, the fluid will pass to the expandable locking means via the one-way valve thereby hydraulically expanding the locking means against the wellbore wall. Thus, the predetermined first pressure matches the pressure required to expand the locking means against the wellbore wall. Once the locking means has been radially expanded, the pressure of the fluid that is being pumped down the drill string is increased to a predetermined second pressure such that the ball that is seated on the ring seal is pushed downwardly into a catching means and flow of fluid through the drill string to the drill bit is resumed. Preferably, the end of the tubing that is withdrawn from the gathered pack is locked in place in the wellbore by being sandwiched between the wellbore wall and the expanded locking means. Suitably, the radially expandable locking means comprises length of expandable steel tubing arranged around the outside of the drill string. Preferably, the end of the tubing withdrawn from the gathered pack is attached to the outer surface of the expandable steel tubing, for example, using a suitable adhesive. Preferably, the expandable steel tubing has a length in the range 0.5 to 5 feet (15 to 152 cm), preferably 0.5 to 1.5 feet (15 to 46 cm). Diversion of the fluid through the one-way valve will hydraulically expand the expandable steel tubing against the wellbore wall thereby sandwiching the flexible tubing between the wellbore wall and the expanded steel tubing with an annulus being formed between the expanded steel tubing and the drill string. The one-way valve is subsequently deactivated, for example, as described above and the flow of the fluid is redirected to the drill bit.

As the drilling progresses, the flexible tubing is drawn out of the receptacle following downward movement of the bit and periodically is locked into place on the well bore as a liner by further expandable locking means, such as further rings of expanded steel tubing. Sections of such expandable steel tubing may be located as rings round the drill string, especially above the receptacle or round the receptacle ready for subsequent expansion and locking of the liner.

As discussed above, during drilling of the first and second wellbore sections, a drilling fluid is passed through the interior of the drill string and through at least one port in the drill bit to the cutting surfaces of the drill bit where the drill cuttings are entrained in the drilling fluid. There is a pressure drop over the drill bit such that the pressure, $P_3$, at the cuttings surfaces of the drill bit is less than the pressure, $P_4$, in the interior of the drill string. The resulting entrained cuttings stream then flows through a fluid by-pass for the cylindrical receptacle and into the annulus formed about the drill string.

The entrained drill cuttings stream moves in a flow path from the drill bit to the surface via a lower annulus between the drill string and wellbore, at least one of the inlets to the conduit in the drill string, the conduit, at least one of the outlets from the conduit into the upper annulus between the drill string and wellbore, and thence through the upper annulus to the well head and surface. In that flow path the or each pump is located at least partly in the conduit or has an inlet or outlet abutting an outlet or inlet of the conduit, preferably being attached or sealed thereto. The pump inlet may be enclosed by the conduit inlet or the reverse, while the pump outlet may be enclosed by the conduit outlet or the reverse.

The inlet or inlets into the conduit are below the receptacle while the outlet or outlets are above the receptacle.

The pump, which has at least one inlet and at least one outlet, is preferably located in the conduit, and may be upstream of, beside or downstream of the receptacle. When the pump is in the conduit and upstream of the receptacle i.e. below it in use, the pump inlet is preferably facing the conduit inlet, in particular with a converging funnel attached to the pump inlet to direct the entrained cuttings stream from the conduit inlet towards the pump inlet. In this case the pump is usually mounted on the inner wall of the conduit. The pump is also in this case preferably as far as possible below the receptacle, optionally below but preferably at or above the level of the conduit inlet to maximize collection of drill cuttings. When the pump is below the conduit inlet, the pump outlet is preferably attached to a pipe extending downstream in the conduit and ending downstream of the conduit inlet, preferably downstream of the receptacle and especially near, towards or in the conduit outlet. Especially however the pump inlet abuts, especially covers or is sealed to, the conduit inlet to ensure that substantially all the drill cuttings stream from the lower annulus flows into the pump inlet and that substantially none of the drill cuttings stream flowing from the pump outlet passes back through the conduit inlet.

Alternatively the pump may be located in the section of the conduit surrounded by at least part of the receptacle. In this case the pump inlet preferably faces substantially upstream, especially with converging funnel attached to the pump inlet to direct the cuttings stream towards that inlet. The pump is usually located nearer the upper end of the receptacle than the lower end. The pump outlet preferably faces substantially downstream and may produce a diverging, substantially parallel or converging stream. Preferably substantially all the drill cuttings stream from the conduit inlet flows into the pump inlet.

Advantageously however the pump is located in the conduit downstream of the receptacle. The pump inlet preferably faces substantially upstream, especially with a converging funnel attached to the pump inlet to direct the cuttings stream towards that inlet. The pump is usually mounted on the inner wall of the conduit. The pump outlet preferably faces towards the conduit outlet, especially across the conduit substantially normal to the length of the conduit. Advantageously the pump outlet is provided with a body having converging sides such as a funnel to direct the exit flow towards the conduit outlet. This exit flow is also aided by centrifugal force because the drill string and thus the conduit are rotating during drilling. Instead of the funnel, if desired, the pump outlet and the conduit outlet may be joined by a pipe. The pump outlet may advantageously abut the conduit outlet, to which it is sealed, to ensure that substantially all the drill cuttings stream from inside the conduit passes from the pump outlet directly into the conduit outlet and that substantially none of the stream flowing from the pump outlet passes back upstream towards the conduit inlet. The direction of flow from the pump outlet abutting the conduit outlet may be up the upper annulus to the well head and also down it towards the locking means on the well bore wall and the unrolled tubing, which constitute the second and third portions of the flexible tubing.

If desired the pump may be located through the conduit inlet with the pump inlet in the lower annulus and the pump outlet in the conduit, or may be located through the conduit outlet with the pump inlet in the conduit and the pump outlet in the upper annulus. The pump may also be located in the lower annulus with the pump outlet abutting and sealed to the conduit inlet, and the pump inlet in the lower annulus, or may be located in the upper annulus with the pump inlet abutting and sealed to the conduit outlet and the pump outlet in the upper annulus.

Locations for the pump which are wholly inside the conduit are preferred, so as to avoid any parts being potentially damaged during lowering of the drill string carrying the pump or during rotation of the drill string in the wellbore.

At least some and preferably all the drill cutting stream moving from the lower annulus to the upper annulus passes though the pump. When substantially all the stream does not pass through the pump(s), the conduit is provided with at least one one-way valve to stop back flow upstream. If desired in the cases when the pump does not abut the conduit inlet or outlet, and especially when the pump is mounted on the inside wall of the conduit, the flow into the pump inlet may contain a lower concentration of drill cutting solids than that passing through the conduit inlet; this arrangement allows fewer solids to pass through the pump thereby reducing pump wear. This arrangement may result from the rotation of the drill string and the effect may be increased by the presence of appropriate internal curved baffles in the conduit upstream of the pump to direct the drill solids outwardly away from the inner wall. In these cases the pump and a one-way valve may form part of a barrier to upstream movement of the stream.

The conduit inlet and outlet are in the outer wall of the conduit, and hence of the rotating drill string, and provide liquid contact between the interior of the conduit and the lower and upper annulus respectively.

The conduit inlet is below the receptacle, from which it is spaced as far as possible inside the conduit. The inlet is thus preferably located at or near the bottom of the conduit in its outer wall; possible separation of drill cuttings below the inlet can thus be reduced.

The conduit outlet is above the receptacle, from which it is spaced as far as possible inside the conduit. The outlet is thus preferably located at or near the top of the conduit in its outer wall.

The conduit itself may be in the form of an outer annulus between the inner passage of the drill string, which carries the down-flowing drill fluid moving to the drill bit, and the wall of the drill string. In this case the outer annulus may have substantially parallel sides until at least the top of the conduit outlet e.g. to the top of the conduit, but preferably above the receptacle there is a lower part of the outer annulus with such sides and an upper part with a tapered inner conduit wall progressively outwardly extending to the drill string. The conduit outlet may be located in the narrowest part of the tapered outer annulus, or may be in the narrowest part that is capable of receiving the pump, especially when the pump outlet abuts the conduit outlet or is sealed to it.

If desired, instead of the conduit being the outer annulus of the drill string, the conduit may be constituted by at least one pipe extending from the conduit inlet [or inlets] to the conduit outlet. In this case the down flowing drill fluid passes down the drill string without any significant restriction in diameter in its inner passage. If desired, whatever the nature of the conduit, there may be one or more than one e.g. 2-4 inlets from the lower annulus, and one or more than one e.g. 2-4 outlets into the upper annulus, preferably the same number of each. The inlets and outlets are usually each independently disposed in the drill string wall but are preferably symmetrically disposed there.

The inlet(s) may feed a first manifold which is in communication with the conduit(s). The conduit(s) may be in communication with a second manifold which feeds the outlet(s).

Each pipe and/or conduit may contain a pump but preferably there is just one pump overall in the total flow path from the lower annulus to the upper annulus. If desired there may be one conduit inlet and one or more conduit outlet(s) with 1 or at least 2 pipes extending from conduit inlet to pump inlet and a pipe extending from pump outlet to conduit outlet, or at least 2 pipes extending from pump outlet(s) to a corresponding number of conduit outlet(s). The pump may act by forcing the drill cutting stream downstream or by sucking the stream from upstream or both. The pump(s) can be a positive displacement pump. The pump may be a mono pump, especially with one or more conduit inlets feeding the stream to the pump inlets and one pump outlet feeding the conduit outlet; alternatively the mono pump may be located in the pipe from conduit inlet to conduit outlet. Preferably the pump is a centrifugal pump, especially located in the conduit between the receptacle and the conduit outlet, the pump taking all the drill cuttings stream and emitting it through one or 2 or more conduit outlets into the upper annulus. The centrifugal pump preferably extends across the conduit annulus or pipe, and has blades rotating in the full width of the annulus or pipe.

The pump is usually electrically powered, especially with power supplied by power cables extending from the surface e.g. through the drill string or upper annulus. However the power may be supplied by a generator located downhole. The generator may be in the down-flowing drill fluid line in the drill string with cables passing through the inner conduit wall to the pump, or the generator may be located in the up flowing stream in the conduit with cables passing to the pump. The pump may also be mechanically powered with a turbine in the down-flowing line e.g. the inner passage in the drill string geared through the conduit inner wall to the pump. The turbine may be located upstream or preferably in or downstream of the constriction in the drill fluid down line caused by any tapered upper part of an annular conduit.

The drill string comprises a number of sections of drill pipe joined releasably together, usually threaded together. The conduit inlet may be in the same section of drill pipe as that on which the receptacle is mounted, or the inlet may be in a lower section of the drill pipe, while the conduit outlet may be in the same section of drill pipe as that on which the receptacle is mounted, or the outlet may be in an upper section of the drill pipe. The pump can be in the same section of drill pipe as the conduit inlet or outlet or that on which the receptacle is mounted. If desired the pump and conduit outlet may be in the same drill pipe section, which may be one or more sections above that on which the receptacle is mounted. This configuration may be preferred when the conduit is annular. In this configuration any section of drill pipe between the one with the receptacle and the one with the pump and conduit outlet, also comprises the conduit extending through it, preferably threaded, to the corresponding conduits in adjacent pipe sections.

The present invention also provides a set of drill pipes comprising first and second drill pipes, each of said pipes having a pipe wall and being capable of being reversibly sealed to another of said pipes, said first pipe comprising an axial passage extending therethrough, which defines with the pipe wall a first annular conduit, a first end of which has an outlet through said pipe wall and a second end of which is capable of being reversibly sealed to a second annular conduit of a second drill pipe, said second pipe comprising an axial passage extending therethrough which defines with the pipe wall said second annular conduit which has a first end and a second end, each end capable of being reversibly sealed to an annular conduit of another drill pipe, said second pipe also comprising a receptacle for a cylindrically gathered pack of flexible tubing capable of being supported around the outside of said second pipe on a plurality of bearings thereby being capable of allowing the receptacle to remain stationary if said first and second pipes were rotated, characterized by comprising a pump located at least partly in the first or second conduit or abutting the outlet or an inlet thereof.

There may also be a third pipe defined with the same parameters as the first pipe but rather than there being an outlet through said pipe wall, there is the inlet. Optionally, there may be a fourth pipe comprising an axial passage extending therethrough which defines with the pipe wall its annular conduit having first and second ends, each end capable of being reversibly sealed to the annular conduit of said first, second or third drill pipes.

Said pump may be located in the annular conduit in said first pipe, the pump preferably being located at said outlet.

The invention further provides a drill pipe having the features of the first pipe defined above, wherein said annular conduit comprises a pump located at said outlet or between said outlet and said first end.

The pump forces the drill cuttings stream in the upper annulus towards the surface and also downwards to the partly unrolled tubing extending between the locking means and the receptacle (also described herein as the third portion of flexible tubing). If desired an extra pump may be mounted on the outside of the receptacle facing the well bore, preferably just above the exit for the tubing, in particular facing the section of partly unrolled tubing (the third portion of flexible tubing) near the well bore and/or facing the section of that tubing just leaving the receptacle. The output of this pump may be adjusted as required to compensate for any changes in output of the main pump associated with the conduit.

If desired the receptacle may be fitted with means to control the rate of exit therefrom of the tubing e.g. with a ratchet. The control means preferably allows the tubing to exit at a rate during drilling corresponding to the rate of descent of the drill bit. It may also allow unrolling of the tubing in a controlled direction, such as towards the lowest locking means holding tubing against the well bore but not allowing unrolling upwards, at an angle of less than 30 degrees to the local well bore axis and especially not allowing unrolling upwards substantially parallel to the well bore axis. Preferably the control means does not allow unrolling downwards at an angle of more than 160 degrees to the local well bore axis but especially straight downwards.

Formation pressure $P_2$ may vary in different locations through which the well bore is being drilled. The changes may sometimes be in a very short distance so that drilling can result in wide swings in well bore pressure, which are dangerous. If the formation pressure $P_2$ is greater than the upper annulus pressure $P_1$, the drill cuttings stream will be contaminated with formation fluids, the liner will be separated from the well bore wall below the lowest locking means and the tubing will unroll from the receptacle. In a further aspect of the present invention, there are pressure sensing means located on either side of the flexible tubing, and also feedback control loop means, from the sensing means and the pump, controlling the pump output depending on the pressure difference across the tubing. In this way the value of the pressure in the upper annulus namely $P_1$ can be constantly maintained above $P_2$ in spite of any variations in the latter. This approach is especially valuable when drilling through shale or another formation of low permeability to fluids, behind which the formation pressure is extra high. Drilling can release that pressure unless controlled as in this aspect of the present invention. This aspect of the present invention therefore has a benefit of improving well stability.

BRIEF DESCRIPTION OF THE DRAWINGS

The present invention will now be described, by way of example only, with reference to FIG. 1, which shows a schematic view of a drilling system.

DETAILED DESCRIPTION OF PREFERRED EMBODIMENTS

A wellbore 1 is drilled to above a lost circulation zone 2 of a formation using a drill string 3 having a drill bit 4 on the lower end thereof. A receptacle 5 for a cylindrically gathered pack of tubing 6 is supported around the lower end of the drill string 2 on a plurality of roller bearings 7. A first end of the gathered pack of tubing 6 is connected to a radially expandable locking means 8 and is locked in place in the wellbore 1 at a position immediately above the lost circulation zone 2 by being sandwiched between expanded locking means 8 and the wellbore wall (as a second portion of tubing). As the drill string moves downwards, more and more tubing is withdrawn from the receptacle for forming a liner 15 against the walls of the wellbore through the lost circulation zone.

Drilling fluid is passed from the surface through the interior of the drill string 3 at a pressure, $P_4$, to ports 9 in the drill bit 4 and out over the cutting surfaces of the drill bit. A pressure drop exists over the drill bit such that the pressure, $P_3$, at the cutting surfaces of the drill bit 4 is less than pressure, $P_4$, in the interior of the drill string. Drilling fluid having cuttings entrained therein passes from the drill bit 4 to upper annulus 10 through an annular conduit 11 formed in the drill string. The conduit 11 has symmetrically disposed openings through the drill string wall, forming inlets 13 and outlets 14 for the conduit 11.

The receptacle 5 is located on the drill string between the inlets 13 and outlets 14 so that when the locking means 8 is expanded and locked in place on the wellbore wall, the unrolled tubing extending from the receptacle to the locking means and forming the liner closes off the upstream region of the wellbore i.e. the lower annulus 12 from the downstream region of the wellbore i.e. the upper annulus 10.

An electrically powered pump 16, powered through cables (not shown) from the wellhead, is located in the conduit 11 just upstream of the outlets 14. The pump's inlet faces upstream in the conduit 11 and the outlet faces downstream. The pump has rotating blades 24, as in the case of a centrifugal pump, with the blades extending around the annular conduit 11; there is no back flow upstream of the pump. Alternatively the pump may be enclosed with a defined inlet and outlet as in a mono pump.

The pump 16 pumps fluid from the conduit 11 into the upper annulus 10 and forces drilling fluid with the cuttings entrained therein against the unrolled tubing 20 and liner 15. As a consequence of the pump, the pressure $P_1$ in the upper annulus 10 is greater than the pressure $P_3$ at the drill bit. The difference in pressure can be 5 to 100 psi (34.5 to 689 kPa) or more.

Additionally, the pressure, $P_1$, in the upper annulus 10 is greater than the pressure, $P_2$, in the lost circulation zone 2 of the formation.

Accordingly, the liner 15 is held against the wellbore wall 19 due to the pressure, $P_1$, in the upper annulus 10 being greater than the pressure, $P_2$, in the lost circulation zone 2, and the liner is prevented from peeling off the wellbore wall due to the pressure $P_1$, in the upper annulus 10 being greater than the pressure, $P_3$, in the lower annulus 12. The required value for the pressure, $P_1$, in the upper annulus can be achieved by maintaining a sufficiently high pressure, $P_4$, of the drilling fluid passing through the interior of the drill string and by appropriate control of the pump as discussed below.

In this example of the invention, there can be a control system that helps to control the differential pressure between $P_1$ in the upper annulus 10 and $P_3$ in the lower annulus 12. This differential can be useful to ensure that the rate of release of the tubing from the receptacle is controlled to allow or prevent, as desired, 'ballooning' of the tubing 6 upwardly or downwardly in the wellbore.

In the control system, pressure sensors may be located on both sides of the liner, i.e. there may be one or more sensors upstream of the liner and one or more sensors downstream of the liner. The output of the sensors can be used to increase or decrease the output of the pump as necessary. For example, if the pressure, $P_3$, on the upstream side of the liner exceeds the pressure, $P_1$, on the downstream side of the liner, fluid can push between the liner and the wellbore wall, causing the liner to peel away from the wellbore wall. In the invention, if a lower pressure downstream of the liner compared with the pressure upstream of the liner is detected by the sensors, the output of the pump is increased so as to increase the pressure downstream of the liner, thereby ensuring that the liner is pressed against the wellbore wall.

As mentioned above, the control system can also control the release of the tubing from the receptacle. In the simplest form, there may be guide means 17 at the open end of the receptacle 5 to guide the smooth deployment of the tubing 6. The open end of the receptacle 5 can also be restricted, for example by providing opposing surfaces or rollers 18 between which the tubing passes. The surfaces or rollers can apply a pressure to the tubing to resist the free passage of the tubing out of the receptacle. Accordingly, a predetermined force must be applied to the tubing to withdraw tubing from the receptacle.

In this way, tubing is withdrawn from the receptacle only when the drill bit moves down or when a predetermined pressure difference exists between the upper annulus 10 and the lower annulus 12. This avoids unintentional ballooning of the tubing when only a small pressure difference exists between the upper annulus 10 and lower annulus 12.

In a more advanced embodiment, one or more sensors are located at the open end of the receptacle to detect the angle made by the tubing as it leaves the receptacle and the local wellbore axis. The control system permits the tubing to be withdrawn from the receptacle in directions falling within a selected range of angles. Withdrawal of the tubing in directions outside the range is prevented, for example by the opposing surfaces or rollers mentioned above, which can apply an adjustable pressure.

In this example, withdrawal of the tubing from the receptacle is permitted if the angle it makes as it leaves the receptacle with the local wellbore axis is between 45° and 160°, though the angle could be anything between 30° and 180°. It is to be noted that 0° would be parallel to the local wellbore axis and in the upwards direction, whereas 180° would be parallel to the local wellbore axis and in the downwards direction. By preventing the tubing being withdrawn from the receptacle at an angle less than 45°, in the event the pressure. $P_3$, in the lower annulus 12 exceeds the pressure, $P_1$, in the upper annulus 10, the tubing is prevented ballooning up into the upper annulus and peeling away from the wellbore wall. By allowing deployment of the tubing up to angles of 160°, some ballooning of the tubing downwardly into the lower annulus is permitted.

The invention claimed is:

1. A device for lining the wall of a wellbore as said wellbore is being drilled through a subterranean formation using a drill string having a drill bit on a lower end of the drill string, the device comprising:

(a) a receptacle for a cylindrically gathered pack of flexible tubing supported around the outside of the drill string at or near the lower end thereof on a plurality of bearings thereby allowing the receptacle to remain stationary while the drill string is rotated;

(b) a radially expandable locking device attachable either directly or indirectly to a first end of the tubing of the gathered pack, said radially expandable locking device being expanded against the wellbore wall to lock the first end of the flexible tubing in place in the wellbore such that in use movement of the drill string through the wellbore as the wellbore is being drilled causes the flexible tubing to be withdrawn from the cylindrically gathered pack and to be turned inside out thereby providing a liner for the wellbore wall with an outer surface of the tubing of the cylindrically gathered pack forming an inner surface of the liner; and (c) at least one conduit having at least one inlet upstream of the receptacle and at least one outlet downstream of the receptacle;

wherein at least one pump is located at least partly in the conduit or abutting said inlet or outlet thereof, and pumps the drilling fluid so that a fluid pressure inside the liner is greater than a fluid pressure at the drill bit.

2. The device according to claim 1 which further comprises said gathered pack of flexible tubing in said receptacle.

3. The device according to claim 2, wherein said pump is located in said conduit.

4. The device according to claim 3, wherein said pump is located downstream of said receptacle.

5. The device according to claim 2, wherein said pump is a centrifugal pump.

6. The device according to claim 2, further comprising a control system for controlling release of said tubing from said receptacle.

7. The device according to claim 6, wherein the control system includes, at an exit for said tubing from said receptacle, a device for resisting release of said tubing from said receptacle.

8. The device according to claim 7 wherein the device for resisting release of said tubing from said receptacle comprises a ratchet, opposing surfaces or opposing rollers.

9. The device according to claim 6, wherein the control system includes pressure sensing means on either side of the tubing, the control system being operable to maintain a higher pressure downstream of the tubing than upstream of the tubing.

10. The device according to claim 2, wherein at least one additional radially expandable locking device is provided for locking further sections of the flexible tubing in place in the wellbore as the tubing is withdrawn from the receptacle.

11. A drill string for use in drilling a wellbore through a subterranean formation comprising at least one drill string section and a device as claimed in claim 1, the receptacle of said device being supported around said at least one drill string section and the conduit of said device extending through said at least one drill string section.

12. A drilling system for drilling a wellbore through a subterranean formation comprising a drill string as claimed in claim 11 and a drill bit on a lower end of said drill string.

13. The device according to claim 1 wherein the radially expandable locking device comprises a length of expandable steel tubing arranged around the outside of the drill string.

14. A method of sealing the wall of a wellbore as said wellbore is being drilled through a subterranean formation using a drill string having a drill bit on a lower end of the drill string, which method comprises (a) fitting a device as claimed in claim 2 to the lower end of a drill string, the conduit of said device extending through at least part of the drill string;

(b) drilling a first section of wellbore using a drilling fluid;

(c) expanding the radially expandable locking device against the wellbore wall such that the end of the tubing that is withdrawn from the gathered pack is locked in place in the wellbore;

(d) drilling a second section of wellbore with movement of the drill string through the wellbore causing the tubing to be withdrawn from the gathered pack and to be turned inside out thereby forming a liner for the second section of wellbore; and (e) pumping the drilling fluid through said conduit by said pump.

* * * * *